US007726380B2

(12) United States Patent
Hirata et al.

(10) Patent No.: US 7,726,380 B2
(45) Date of Patent: Jun. 1, 2010

(54) METHOD FOR MANUFACTURING SAND MOLD

(75) Inventors: Minoru Hirata, Toyokawa (JP); Kimikazu Kaneto, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 558 days.

(21) Appl. No.: 11/578,772

(22) PCT Filed: Apr. 21, 2005

(86) PCT No.: PCT/JP2005/007615

§ 371 (c)(1),
(2), (4) Date: Aug. 2, 2007

(87) PCT Pub. No.: WO2005/102561

PCT Pub. Date: Nov. 3, 2005

(65) Prior Publication Data

US 2008/0093044 A1 Apr. 24, 2008

(30) Foreign Application Priority Data

Apr. 21, 2004 (JP) ..... 2004-125529
May 20, 2004 (JP) ..... 2004-150485

(51) Int. Cl.
*B22C 15/24* (2006.01)

(52) U.S. Cl. ..... 164/21; 164/200

(58) Field of Classification Search ..... 164/19–22, 164/200–202

See application file for complete search history.

(56) References Cited

U.S. PATENT DOCUMENTS 6,668,904 B1 * 12/2003 Johansen ..... 164/7.1
2002/0157800 A1 * 10/2002 Kaneto et al. ..... 164/20

FOREIGN PATENT DOCUMENTS

| | | | |
|---|---|---|---|
| EP | 1 240 957 | A2 | 9/2002 |
| EP | 1 433 548 | A1 | 6/2004 |
| JP | 56-68551 | | 6/1981 |
| JP | 2002-346697 | | 12/2002 |
| JP | 2002-346698 | | 12/2002 |
| WO | WO 03/013762 | A1 | 2/2003 |

* cited by examiner

*Primary Examiner*—Kuang Lin
(74) *Attorney, Agent, or Firm*—Finnegan, Henderson, Farabow, Garrett & Dunner L.L.P.

(57) ABSTRACT

A method of producing a sand mold, comprising: after defining a mold space at least by a pattern plate, a flask, and a squeeze means, and after blow-charging molding sand held in a sand blowing device located above the mold space into the mold space by ejecting a first compressed air near sand ejecting ports of the sand blowing device thereby fluidizing the molding sand near the sand ejecting ports, while supplying a second compressed air to a surface of the molding sand held in the sand blowing device, moving the squeeze means toward the pattern plate, where in the pressure of the first compressed air and the period of time for supplying the first compressed air are adjusted to produce a good sand mold. To determine the period of time for ejecting the first compressed air, the distance of the movement of the squeeze feet toward the pattern plate is measured when the squeeze of the molding sand in the mold space is completed, and the difference between the measured distance and a target distance is calculated. The period is adjusted to be a shorter or lengthened one based on the result of the calculation.

7 Claims, 4 Drawing Sheets

METHOD FOR MANUFACTURING SAND MOLD

TECHNICAL FIELD

This invention relates to a method of producing a sand mold.

BACKGROUND ART

A conventional method of producing a sand mold is disclosed in JP 2002-346697A, wherein after a mold space is defined by a flask placed on a pattern plate, a filling frame placed on the flask, and multiple squeeze heads inserted in the filling frame from above, and after the molding sand located at sand ejecting ports of a sand blowing device is fluidized by ejecting a compressed air to the molding sand at that location, a compressed air is supplied to the upper surface of the molding sand in the sand blowing device for a predetermined period of time to blow-charge the molding sand from the sand blowing device into the mold space, and the squeeze heads are lowered to squeeze the molding sand such that the level of the upper surface of the produced sand mold coincides with that of the flask.

However, in the conventional method of producing a sand mold as configured above, the squeeze length of the molding sand varies as the CB value (compactability) of molding sand, which is a property of the molding sand, varies. Thus the level of the upper surface of the produced sand mold tends to be lower or higher than that of the flask.

To attempt to overcome this drawback, the position, or level, of the squeeze heads are changed to change the volume of the mold space. However, if the volume after changed is large, the period of time for blow charging the molding sand, which is the period for supplying a compressed air to the surface of the molding sand, would be short and causes insufficient blow charging.

Further, the inventors of the present invention have developed a molding machine, wherein after upper and lower mold space halves are defined by upper and lower flasks, each formed with a sand blow-in port in its sidewall, a match plate disposed between the upper and lower flasks, and upper and lower squeeze means provided with a plurality of squeeze feet to be inserted in the upper and lower mold space halves from the openings located at one side opposite to the other side of each of the upper and lower flasks located at the match plate, and after molding sand is blow charged from the sand ejecting nozzles of a sand blowing device through sand blow-in ports into the upper and lower mold space halves, the upper and lower squeeze heads are approached each other to compact the molding sand in the mold space halves to produce mold halves. However, since in this conventional molding machine the compressed air is ejected under a high pressure to blow charge the molding sand well, the sand ejecting nozzles tend to be clogged, casing insufficient blow charge and necessitating troublesome cleaning of the nozzles.

DISCLOSURE OF THE INVENTION

The purpose of the present invention is to provide a method of producing a good sand mold by eliminating the clogging and insufficient blow charge.

To the end, the method of the present invention includes defining a mold space by at least a pattern plate, a flask, and a squeeze means; blow-charging molding sand held in a sand blowing device located above the mold space into the mold space by ejecting a first compressed air near sand ejecting ports of the sand blowing device thereby fluidizing the molding sand near the sand ejecting ports, while supplying a second compressed air to a surface of the molding sand held in the sand blowing device; and after the blow charging, moving the squeeze means toward the pattern plate, wherein the pressure of the first compressed air or the period of time for ejecting the first compressed air is adjusted to produce a good sand mold. The pressures of the first and second compressed airs are selected as proper ones. To determine the period of time for ejecting the first compressed air, the distance of the movement of the squeeze feet toward the pattern plate is measured when the squeeze of the molding sand in the mold space is completed, and the difference between the measured distance and a target distance is calculated. The period is adjusted to be a shorter or lengthened one based on the result of the calculation.

The other purposes, features, and advantages will be apparent from the following description for some embodiments with reference to the accompanying drawings.

PREFERRED EMBODIMENTS FOR CARRYING OUT THE INVENTION

Figure 1:
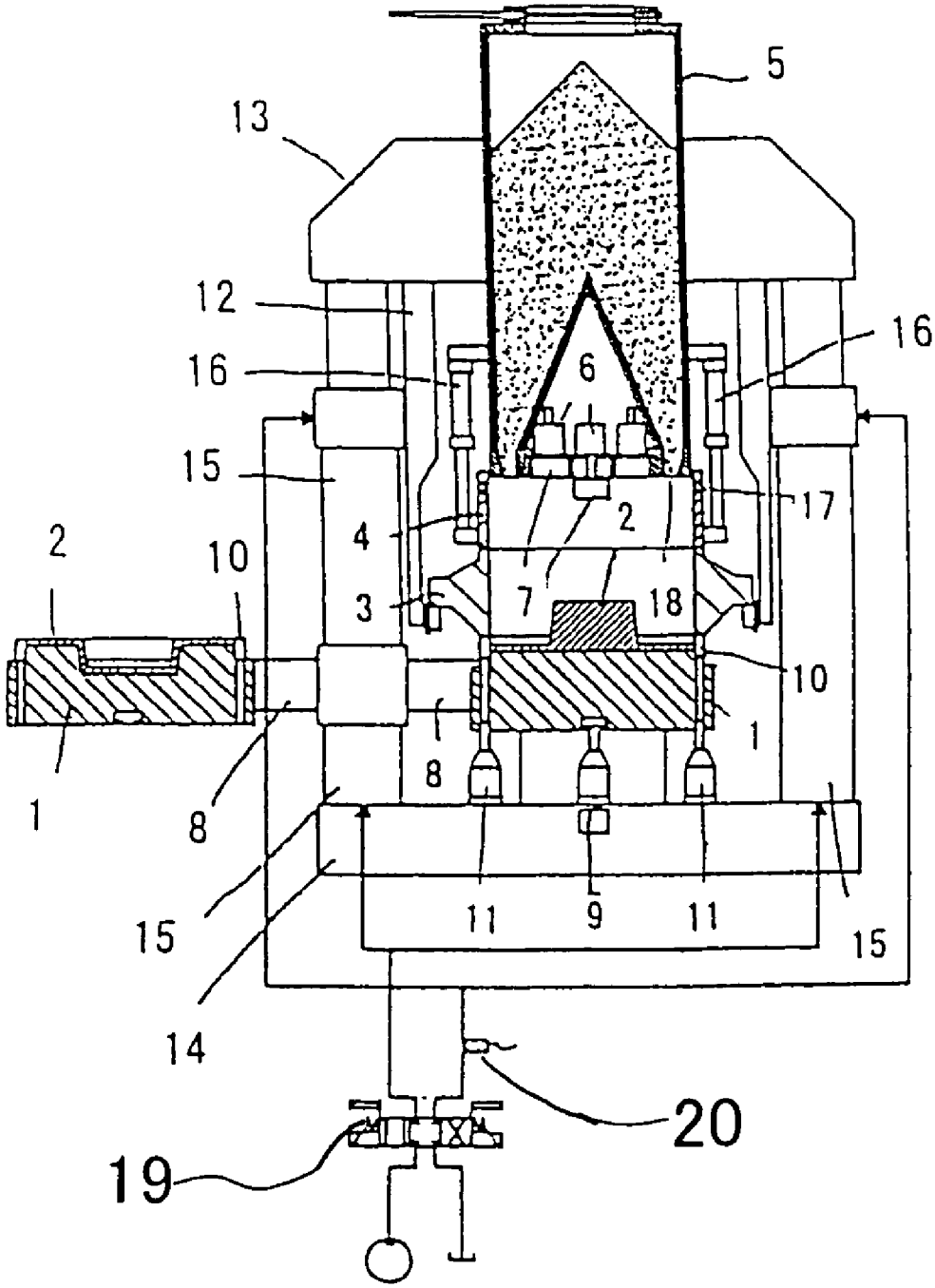
FIG. 1 is a partly sectional front view of a first embodiment of a molding machine for carrying out the method of the present invention.
Figure 2:
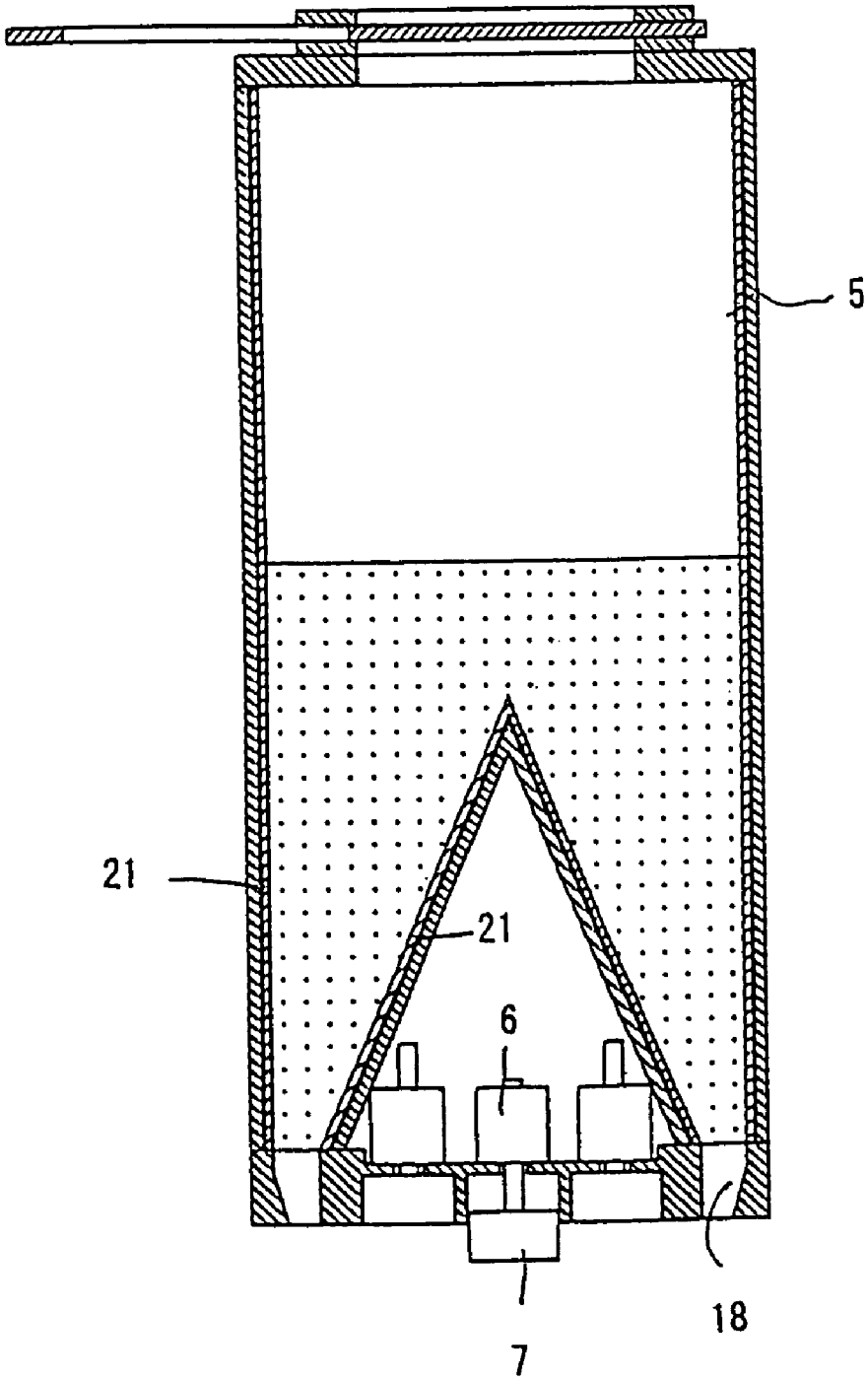
FIG. 2 is an enlarged view of the main part of the molding machine of FIG. 1.

A first embodiment of the method of the present invention is now explained in relation to a molding device shown in FIGS. 1 and 2 that uses the method. The molding machine shown in the drawings includes pattern plates 2, 2 each mounted on a transfer member 1 shaped as a surface plate, a molding flask 3 placed on the pattern plate 2, a filling frame 4 disposed for vertical moving above the flask 3, a sand blowing device 5 disposed for vertical moving above the filling frame 4 and having a lower end that slidably fits in the filling frame 4, and a plurality of squeeze feet 7, 7 mounded on the lower end of the sand blowing device 5, the squeeze feet are vertically moved by air cylinders 6, 6. There are two transfer members 1, 1 attached to arms 8, 8 that are horizontally rotatable, and each transfer member can be located in a position just below the filling frame 4 and can be away and out of the position. The transfer device 1 located at the positional is moved up to a designated position by allowing the piston rod of a positioning cylinder 9 mounted on a machine base 14 (later described in detail) to engage a notch formed in the transfer device and to lift the transfer device. An annular demolding frame 10 is mounded on each transfer device 1. The annular demolding frame 10 is free to vertically slide around the pattern plate 2 and is lifted by upwardly facing cylinders 11, 11 mounted on the machine base (later described) when they are activated to extend.

Further, the filling frame 3 is adapted to be located in a position just above the pattern plate 2 and moved away from the position by a roller conveyor 12 provided with collars and to be lifted by the roller conveyor that is suspended from the bottom of a lifting frame 13. The lifting frame 13 is mounted on the piston rods of two upright, upwardly-facing cylinders 15, 15 mounted on the machine base 14 at its right and left sides, so that it is lifted when the cylinders 15, 15 are activated to extend. A hydraulic circuit 19 for the cylinder 15, 15 includes a pressure sensor 20 to act as means for detecting the reaction force against the squeeze feet 7. When the reaction force exceeds a predetermined value, a signal from the pressure sensor 20 causes the air cylinders 6, 6, which are now extending, to start retracting.

Further, the filling frame 4 is lifted by cylinders 16, 16 mounted on the sand blowing device 5 at its right and left sides. The filing frame 4 is also formed with vent holes 17, 17 that communicate with a air-controlling chamber (not shown) for controlling air to be discharged. The sand blowing device 5 is mounted in the lifting frame 13 such that it vertically passes through the lifting frame 13. The lower part of the sand blowing device diverges and have a sand ejecting port 18 at each diverged lower part.

As shown in FIG. 2, the sand blowing device 5 further includes compressed air ejecting means 21 near the sand ejecting ports 18 for fluidizing the molding sand near the sand ejecting ports 18.

The operation of the molding machine constituted as discussed above is now explained. By actuating the positioning cylinder 9, the transfer member 1 is located in position on the machine base 14, and the upwardly facing cylinders 11, 11 are extended to lift the demolding frame 10. The cylinders 15, 15 are retracted to place the flask 3 on the demolding frame 10, and the cylinders 16, 16 are extended to allow the filling frame 4 to come into contact with the flask 3. Further, the central air cylinder 6 is extended to lower its squeeze foot 7. Thus a mold space is defined by the pattern plate 2, the demolding frame 10, the flask 3, the filling frame 4, the sand blowing device 5, and the plurality of squeeze feet 7, 7 such that squeeze feet and the pattern portion of the pattern plate 2 are spaced away at different distances, i.e., at two different distances A and B before the molding sand in the mold space is compacted. Assuming that these distances become a and b, respectively, after the molding sand is compacted, the compaction is performed to achieve the relation of a/A=b/B.

A first compressed air is then ejected from the air ejecting means of the sand blowing device 5 to fluidize the molding sand near the sand ejecting ports, while a second compressed air is supplied to the upper surface of the molding sand in the sand blowing device 5 to blow-charge the molding from it into the mold space. The cylinders 15, 15 are then retracted to lower the sand blowing device 5, the squeeze feet 7, 7, etc., to preliminarily compact the molding sand in the mold space. The air cylinders 6, 6, are then retracted to lift their squeeze feet 7, 7, and then the cylinders 15, 15 are further retracted to lower the sand flowing device 5, the squeeze feet 7, 7, etc., to squeeze the molding sand which has been preliminarily compacted.

The distance of the movement of the squeeze feet that have moved downward at the completion of the squeeze is detected by a conventional means, and the difference between the detected value and a target value for the distance is calculated. Further, based on the result of this calculation, the period of time of ejecting the first compressed air for fluidizing the molding sand is shortened or lengthened to vary the condition for blow-charging the molding sand into the mold space.

By doing so, in the molding thereafter the molding sand is blow-charged by using the principle in that the squeezing length of the molding sand varies relative to the variation in a CB value (compactability).

The cylinders 15, 15 are then extended to lift the flask 3, etc. for remolding, and the cylinders 16, 16 are activated to return the filling frame 4 to its original position. The flask 3, which contains a produced sand mold, is then transferred away from the molding machine along the roller conveyor 12, and an empty flask 3 is transferred into the molding machine. Thus one cycle is completed.

Although in the first embodiment the mold space is defined by the pattern plate 2, the flask 3 placed on the pattern plate 2, the filling frame 4 placed on the flask 3, and the multiple squeeze feet as squeeze means inserted in the filling frame 4 from above, it is not limited so. For example, as in a second embodiment as will be explained below, a mold space may be defined by a match plate, upper and lower flasks that sandwich the match plate, and squeeze means located at the side of each of the upper and lower flasks opposite to the other side located at the match plate.

Figure 3:
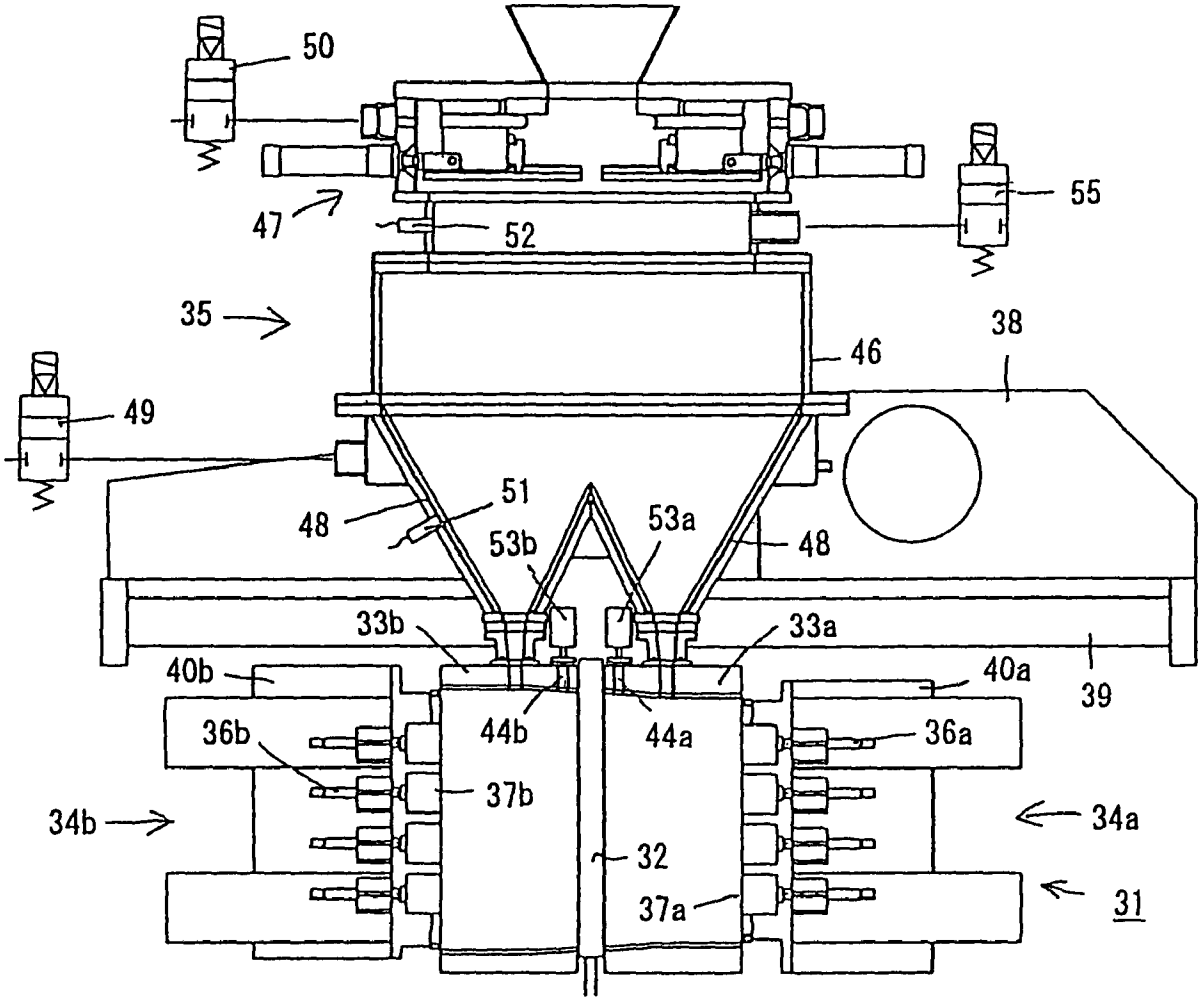
FIG. 3 is a partly sectional front view of a second embodiment of the molding machine for carrying out the method of the present invention.
Figure 4:
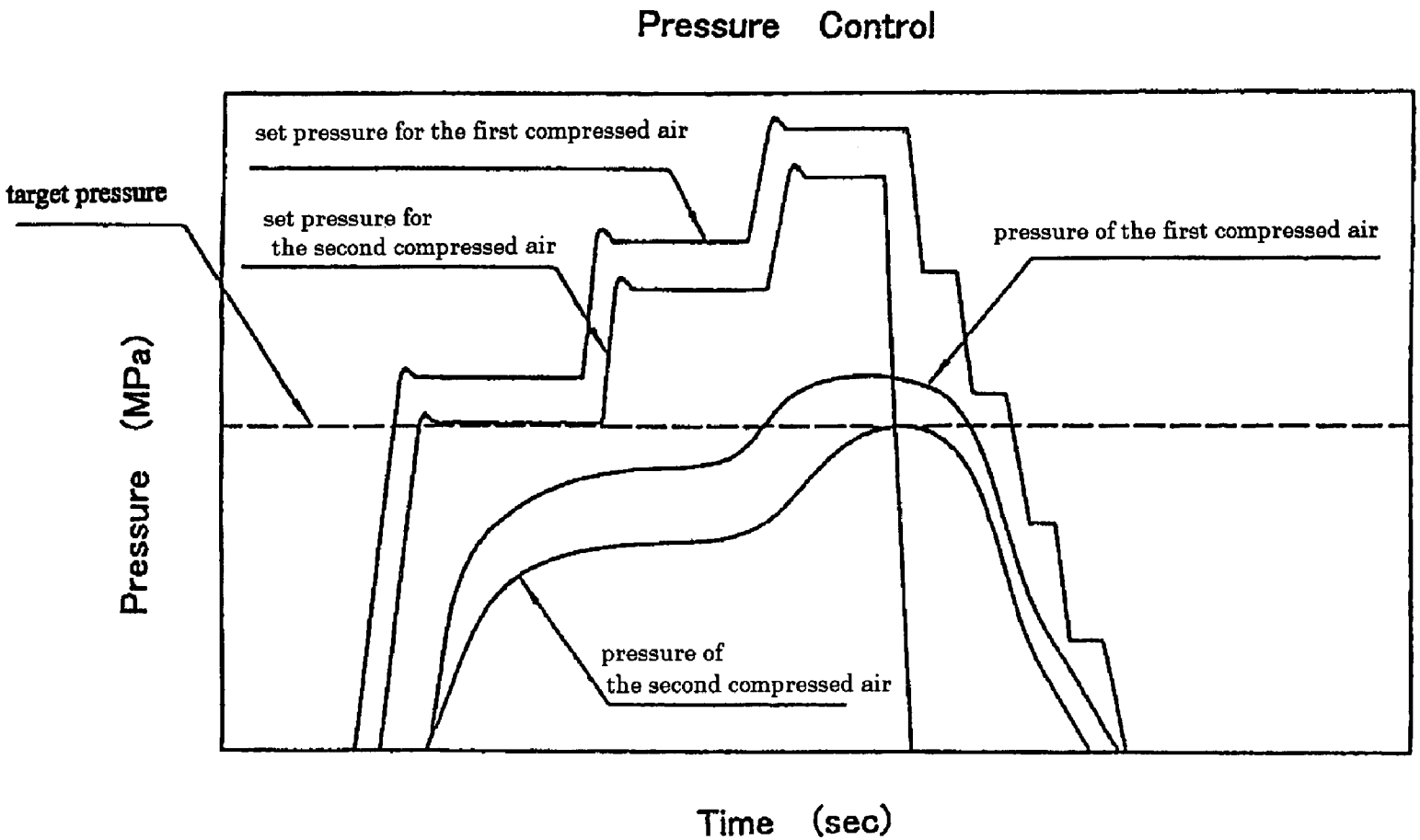
FIG. 4 is a graph showing the pressures of various compressed airs supplied to a sand blowing device in the second embodiment, as well as the variation in the pressures over time.

The second embodiment of the molding machine (for producing a cope and a drag that have no flask) used for carrying out the method of the present invention is now explained with reference to FIGS. 3 and 4. As shown in FIG. 3, the molding machine for producing a cope and a drag that have no flask includes a pair of upper and lower flask 33*a*, 33*b*, each formed with sand blow-in port in its side wall; a match plate 32, which can be inserted between the upper and lower flasks and has one or more vent holes therein; a molding sand squeeze mechanism 31 having upper and lower squeeze devices 34*a*, 34*b* provided with a plurality of upper and lower squeeze feet 37*a* and 37*b*, respectively, the mechanism 31 adapted to support and allow the upper and lower squeeze feet 37*a* and 37*b* to enter the upper and lower flasks 33*a* and 33*b*, respectively, from the sides opposite the other sides located at the match plate and adapted to support and allow the upper and lower flasks to reversely rotate to be located between a vertical positioned shown in FIG. 3 and a horizontal position; and a sand blowing device 35 secured to the ceiling of the machine table (not shown) for blowing molding sand from its sand ejecting port into the upper and lower flask 33*a*, 33*b* located in the horizontal position.

Further, the molding sand squeeze mechanism 31, which acts as squeeze means, includes a rotary frame 38 pivoted at its center to reversibly rotate about the pivot in a vertical plane. A pair of horizontally extending guide rods 39, 39 spaced-apart in the directions forward and rearward are secured to the rotary frame 38 (only one of them is seen in FIG. 3). An upper lifter frame 40*a* and a lower lifter frame 40*b* are slidably mounted on right and left parts of the guide rods 39, respectively, through a holder part. The upper and lower lifter frames 40*a*, 40*b* are moved to approach and spaced apart from each other by the extension and retraction of a downwardly facing cylinder and an upwardly facing cylinder, both of which (not shown) are secured to the rotary frame 38.

Further, the upper and lower flasks 33*a* and 33*b* are formed with air discharge ports 44*a* and 44*b*, respectively, and the air discharge ports 44*a* and 44*b* are opened and closed by a valve 53*a* and a valve 53*b* attached to the upper and lower flasks 33*a* and 33*b*, respectively.

Further, the upper lifter frame 40*a* has a plurality of cylinders 36*a* for advancing the upper squeeze feet 37*a*, and similarly, the lower lifter frame 40*b* has a plurality of cylinders 36*b* for advancing the lower squeeze feet 37*b*.

The upper part of the body 46 of the sand blowing device 35 comprises vertically arranged, stepped small and large cylindrical parts. And the lower part thereof diverges so that the lower ends of the diverged parts engage the sand blow-in ports of the upper and lower flasks 33*a*, 33*b*. A gateway mechanism 47 for opening and closing a top opening of the body 46 is mounted on the top of the body 48. Further, two sand fluidizing means 48, 48 for ejecting a first compressed air to fluidize molding sand are attached to the lower part of the sand blowing device 35. The fluidizing means 48, 48 communicate with a compressed air source (not shown) via on-off valve 49. The pressure of the compressed air ejected from the sand fluidizing means 48, 48 is preferably 0.05-0.18 MPa. Further, a compressed air source (not shown) for supplying a second compressed air to press the molding sand communicates with the upper portion of the body 46 via on-off valve 50. Further, pressure sensors 51 and 52 for detecting the pressures of the compressed airs are attached to the sand fluidizing means 48 and the upper part of the body 46. The upper part of the body 46 communicates with the atmosphere via on-off valve 55.

In the operation of the molding machine constituted as discussed above, as shown in FIG. 3, a predetermined amount of molding sand is introduced into the body 46 with the air discharge ports 44*a*, 44*b* of the upper and lower flasks 33*a*, 33*b* being closed by the valve mechanisms 53*a*, 53*b*, and the mold space, which is defined by the upper and lower flasks 33*a*, 33*b*, the match plate 32, and the upper and lower squeeze means 34*a*, 34*b*, is then rotated to the vertical position to allow the sand blow-in ports of the upper and lower flasks 33*a*, 33*b* to mate with the lower ends of the sand blowing device 35. The on-off valves 49, 50 are then opened to supply compressed airs to the sand fluidizing means and the upper part above the molding sand in the body 46. As shown in FIG. 4, during the supply of the compressed airs to the sand fluidizing means 48, 48 and the upper part in the body 46 their pressures are detected by the pressure sensors 51 and 52 and made greater stepwise over time, to allow the actual pressure at the upper part above the molding sand in the body 46 to quickly approach a target pressure. And, to prevent the molding sand in the body 46 from entering the chamber of the sand fluidizing means 48, 48, the pressure of the first compressed air to be supplied to the sand fluidizing means 48, 48 is made greater some desired degree than the pressure of the second compressed air to be supplied to the upper part in the body 46.

Thus, the first compressed air of 0.05-0.18 MPa is ejected from the sand fluidizing means 48, 48 to fluidize the molding sand located at the lower part in the body 48, while the second compressed air is being supplied to the upper part above the molding sand to press the molding sand, thereby blow-charging the molding sand into the upper and lower mold space halves. Accordingly, the molding sand is blow-charged into the mold space halves by compressed air under a relatively low pressure.

Further, at the initial stage of the blow charging of the molding sand into the mold space halves the air discharge ports 44*a*, 44*b* of the upper and lower flask 33*a*, 33*b* are closed by the valve mechanisms 53*a*, 53*b* to discharge the air from the vent hole or holes in the match plate, to obtain good compaction of the molding sand at the vent holes. And, at the last stage of the blow charging the air discharge ports 44*a*, 44*b* are opened by the valve mechanisms 53*a*, 53*b* to discharge the air in the flasks from their air discharge ports 44*a*, 44*b*, to obtain good compaction of the molding sand also at the ports and to facilitate to discharge the air from the mold space halves.

In the mold machine of the second embodiment the first and second compressed airs are supplied in the sand blowing device, wherein the pressure of the first compressed air is kept greater than that of the second one, and the both pressures are made greater stepwise over time. To blow-charge the molding sand quickly and sufficiently into the mold space halves, the pressures of the first and second airs and the period of time of supply them may be adjusted relative to the volumes of the upper and lower mold space halves based on the measurements of the produced sand molds.

It is clear that the method of the invention carried out in the second embodiment for producing flask-less molds can be applied to the molding machine for producing sand molds with flasks (as in the first embodiment). The first and second compressed airs can be applied to the first embodiment.

The invention claimed:

1. A method of producing a sand mold, comprising:

after defining a mold space by at least a pattern plate, a flask, and a squeeze means, and after blow-charging molding sand held in a sand blowing device located above the mold space into the mold space by ejecting a first compressed air near sand ejecting ports of the sand blowing device thereby fluidizing the molding sand near the sand ejecting ports, while supplying a second compressed air to a surface of the molding sand held in the sand blowing device, moving the squeeze means toward the pattern plate, wherein the distance of the movement of the squeeze means toward the pattern plate is measured when the squeeze of the molding sand in the mold space is completed, the difference between the measured distance and a target distance is calculated, and based on the result of the calculation the period of time for ejecting the first compressed air is made shorter or lengthened to change a condition for blow-charging the molding sand in the mold space.

2. The method of producing a sand mold of claim 1, wherein the mold space is defined by a pattern plate, a flask placed on the pattern plate, a filling frame placed on the flask, and multiple squeeze feet as the squeeze means inserted in the filling frame from above.

3. The method of producing a sand mold of claim 1, wherein the mold space is defined as upper and lower mold space halves by a match plate, upper and lower flasks holding the match plate therebetween, and upper and lower squeeze feet as the squeeze means inserted in openings of the upper and lower flasks, respectively, the openings being on sides of the upper and lower flasks that are opposite from openings thereof located at sides adjacent the match plate.

4. The method of producing a sand mold of claim 1, wherein the pressure of the first compressed air is 0.05-18 MPa.

5. The method of producing a sand mold of claim 1 or 4, wherein the pressure of the second compressed air is 0.05-18 MPa.

6. The method of producing a sand mold of claim 3, wherein one or more vent holes are formed in the match plate, an air discharge port is formed in each of the upper and lower flasks, and wherein at a initial stage of blow charging of the molding sand into the upper and lower mold space halves, the air discharge ports are closed, while the one or more vent holes in the match plate are opened to discharge the compressed air therefrom to sufficiently compact the molding sand near the one or more vent holes, and at a last stage of the blow charging the air discharge ports are opened to discharge the compressed air therefrom to sufficiently compact the molding sand near the air discharge ports and to facilitate discharge of the compressed air from the upper and lower flasks.

7. The method of producing a sand mold of claim 3 or 6, wherein the pressures of the first and second compressed airs and the period of time to supply the first and second compressed airs to the sand blowing device are adjusted relative to volumes of the upper and lower mold space halves based on measurements of a produced sand mold.

* * * * *